United States Patent [19]

Sciortino

[11] 4,372,479

[45] Feb. 8, 1983

[54] SELF-LOCKING COVERED COIN RECEPTACLE AND AUTOMATIC RESET MECHANISM THEREFOR

[76] Inventor: August M. Sciortino, 1838 Weeg Way, Park Ridge, Ill. 60068

[21] Appl. No.: 238,617

[22] Filed: Feb. 26, 1981

Related U.S. Application Data

[63] Continuation-in-part of Ser. No. 136,889, Apr. 3, 1980, Pat. No. 4,359,184.

[51] Int. Cl.[3] ..... G07B 15/00

[52] U.S. Cl. ..... 232/15

[58] Field of Search ..... 232/15, 31, 32, 43.2

[56] References Cited

U.S. PATENT DOCUMENTS

| | | | |
|---|---|---|---|
| 988,881 | 4/1911 | Kohler | 232/15 |
| 2,783,937 | 3/1957 | Hudson | 232/15 |
| 3,677,461 | 7/1972 | Nitschneider et al. | 232/15 |
| 4,267,962 | 5/1981 | Domkowski | 232/15 |
| 4,291,831 | 9/1981 | Domkowski | 232/15 |

*Primary Examiner*—Gene Mancene
*Assistant Examiner*—Wenceslao J. Contreras
*Attorney, Agent, or Firm*—Silverman, Cass & Singer, Ltd.

[57] ABSTRACT

An automatic reset mechanism for a self-locking covered coin receptacle for use in coin-controlled machines. The cover includes a channeled member carrying a window and slidably telescopically received within a second channeled member carrying an open-topped flexible bag to be aligned with the window. A spring biased slide is installed on the floor of the channel defined within said first member and operates between a first condition covering the window and a second condition uncovering the window. A band spring member removably is fastened to the first member and includes a bent formation (latch) at its free end arranged to ride the slide when the same is moved to uncover the window, and to block movement of the slide when the window is covered by return of said slide. A spring biased blade, pivotally mounted to the slide for movement therewith when the slide is moved to uncover the window, is mounted to pivot horizontally when engaged by said slide during the retromovement thereof after fully uncovering the window to again cover the same. The bend functions as a latch and drops off the slide, engaging the trailing edge of the slide and biased thereagainst by the spring biased blade whereby to prevent subsequent movement of the slide. The automatic reset mechanism includes an arm carrying a depending cam fixedly secured to the second channeled member positioned across the path of the first channeled member and a lift formed as a part of the band spring arranged to be engaged by the cam during the withdrawal of the first member for gaining access to the bag, the band spring being lifted by the coaction of the cam and lift portion sufficiently to free the bent formation. The depending cam also serves to prevent separation of channeled members.

20 Claims, 10 Drawing Figures

SELF-LOCKING COVERED COIN RECEPTACLE AND AUTOMATIC RESET MECHANISM THEREFOR

CROSS-REFERENCE TO RELATED APPLICATIONS

This application is a continuation-in-part of copending Ser. No. 136,889 filed Apr. 3, 1980, now U.S. Pat. No. 4,359,184 issued Nov. 16, 1982 by applicant herein, the subject matter thereof being incorporated by reference herein and made a part hereof to supply background of this invention.

BACKGROUND OF THE INVENTION

This invention relates generally to locking covers for coin containers of the type used with coin-controlled machines, and provides an improved reset mechanism for a self-locking cover assembly for such containers, the assembly having automatic reset means installed therein operable when the cover assembly is manipulated to gain authorized access to the loaded coin receptacle whereby to cock the locking mechanism for reuse.

Vending machines operated by coins normally have coin containers such as coin boxes or similar receptacles to receive the coins dropped into the machine by those who have purchased merchandise from the machines. Such coin containers are locked into prefabricated recesses provided in the machines. When the machine is serviced, the serviceman removes the loaded coin receptacle, empties it and replaces it within the recess.

For security purposes it has become customary to have a coin container which is locked, and remains locked until it is returned to the proprietor of the vending machine or to an authorized counting station whereat it can be opened and the coins removed. In such cases, the serviceman is provided with an empty, locked container so that when the loaded container is removed from the enclosure, a fresh, empty container replacement can be installed.

In order to prevent pilferage from the coin container subsequent to removal from the machine, the serviceman is not given keys thereto. Accordingly, the container must have a mechanism to meet the following conditions:

The coin container must be in condition to receive the coins when the serviceman installs the same within the enclosure provided in the machine. Normally there is a window in the top of the container which must be opened on installation and remain open after the container is installed, the window being aligned with the delivery end of the coin chute of the machine. This window must be closed at all times when the container is outside the enclosure. When the serviceman removes the loaded container, his act of removal must close the window, lock it in closed condition and must thwart any attempts to gain access to the interior thereof for the surreptitious non-detectable removal of coins therefrom.

A significant cash loss from vending machine collections nontheless remained a persistent problem until the provision of the assembly disclosed and claimed in United States patent application, Serial No. 136,889

Much attention also has been directed to providing locked coin bags for use in vending machines. Of advantage is the ease of transport with security since the loaded bag will be receivable in drum type safes or other secure repositories with minimum bulk space requirement. Thus, the self-locking cover assembly of Serial No. 136,889 was especially suitable for use with coin bags.

The locked coin receptacle is capable of being unloaded, removed from the vending machine, transported with security, unlocked, unloaded, reset and readied for installation with minimum complexity and time lapse.

The referenced application provided a self-locking cover assembly for a coin container wherein the cover includes a first channel member open at one end. A slide is arranged in the channel. A second channel member carrying a flexible coin bag is capable of telescopically receiving the first channel member to complete the cover assembly. A window is formed in the top wall of the first channel member. The window is located to enable alignment with the delivery end of the coin chute of the coin-controlled machine when the bag and locked cover assembly is installed fully into the machine. The slide is movable during entry into the enclosure between a condition whereat the window is blocked to a condition in which the window is open. Means are provided to maintain the open condition thereof while the container remains installed. Means also are provided whereby during and subsequent to the withdrawal of the coin box from the enclosure, the window is blocked and access may not be gained thereto by covert or surrepititious action. In particular, spring means are employed ridable on the slide during uncovering of the window and upon withdrawal against the one edge of the slide to prevent access to be gained to the window. Once installed within the designated enclosure, the locked assembly cannot be withdrawn unless the window is closed off. Once the container is withdrawn, the window cannot be uncovered covertly without detection. Means also were provided to prevent withdrawal of the locked container from the enclosure area so long as the window is even partially uncovered, and to prevent return of the container once it has been removed unless the locking means have been reset.

Once the loaded coin bag and cover assembly was withdrawn from the holding bracket within the coin operated machine, it was transported to the secure counting area where the seal thereof severed and the cover parts separated. Access to the loaded coin bag therefor was obtained and the bag emptied and its contents accounted for. The locking mechanism then was reset to permit assembly of the cover parts. Unless the parts were reassembled, with the locking mechanism properly reset, reentry into a holding bracket of a coin operated machine was not possible, since the slide mechanism could not be operated.

An implement, preferably a sharp pointed implement, was required to be introduced beneath the band spring while the parts of the cover were separated. When introduced beneath the band spring, the sharp implement would be pivoted to lift the band spring from its blocking condition relative to the slide and the pivotable plate. When the band spring was lifted sufficiently for the bent portion thereof to be freed from its blocking condition, the blade was permitted to pivot, permitting in turn to the bent end to ride the slide and the blade. The employment of such tool and the difficulty of the manipulative maneuverings required detered from the acceptability of the unit notwithstanding its security superiority.

Considerable advantage would ensue if the resetting is accomplished automatically when the parts of the cover are reassembled. Further, if the cover could be arranged where the parts need not be, and in fact, cannot be separated, reduction in handling time and loss due to misplacement of the separated parts can be materially reduced. In addition, improved security would result as it would be more difficult to gain unauthorized access to the interior of the locked covered coin receptacle.

SUMMARY OF THE INVENTION

The invention herein particularly is directed to the provision of a self-locking cover assembly for a coin receptacle being permanently coupled for coin-controlled machines, the cover assembly including a pair of telescopically engageable members, said members being capable of limited reciprocation between a latched fully telescopically engaged condition and a partially separated condition, said cover having spring biased locking means and being characterized by resetting means automatically operable when the cover assembly is manipulated to attain the partially separated condition for emptying same, said resetting means comprising means for displacing said locking means from locking condition when one of said members is manipulated to reach the partially separated condition.

DESCRIPTION OF PREFERRED EMBODIMENT

Figure 1:
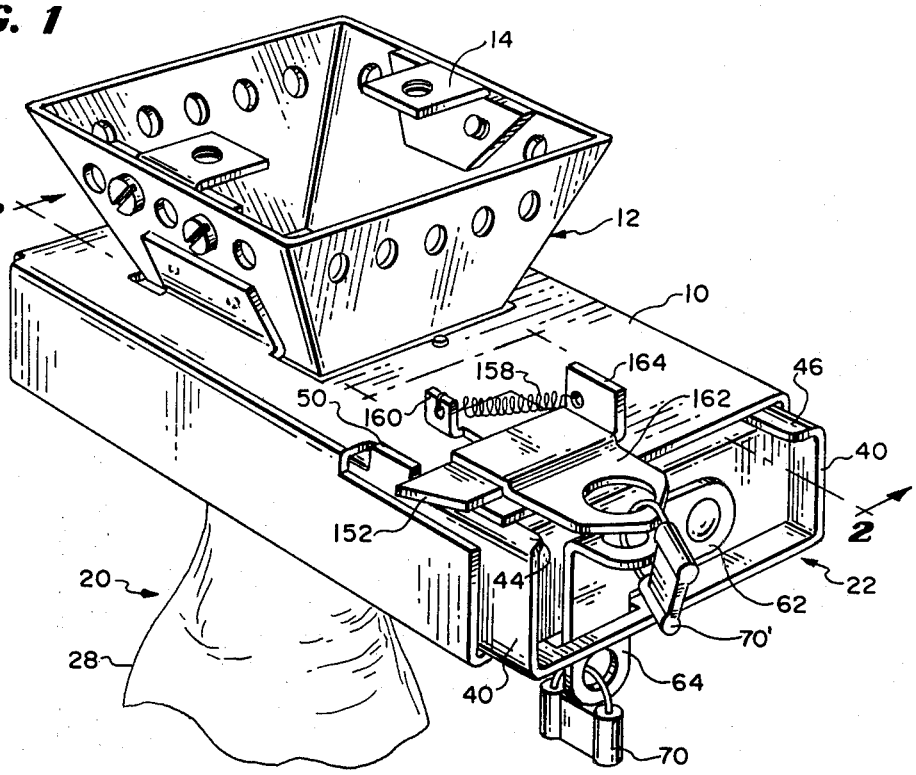
FIG. 1 is a perspective view looking downward of a locked covered coin receptacle bag according to the invention as installed in a preformed bracket structure capable of being secured within an enclosure formed in a conventional coin controlled machine.
Figure 2:
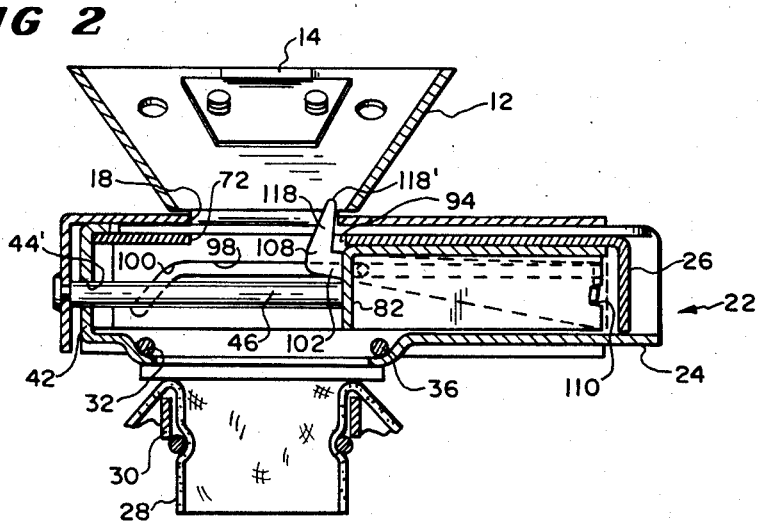
FIG. 2 is a sectional view taken along lines 2—2 of FIG. 1 and viewed in the direction indicated by the arrows.
Figure 3:
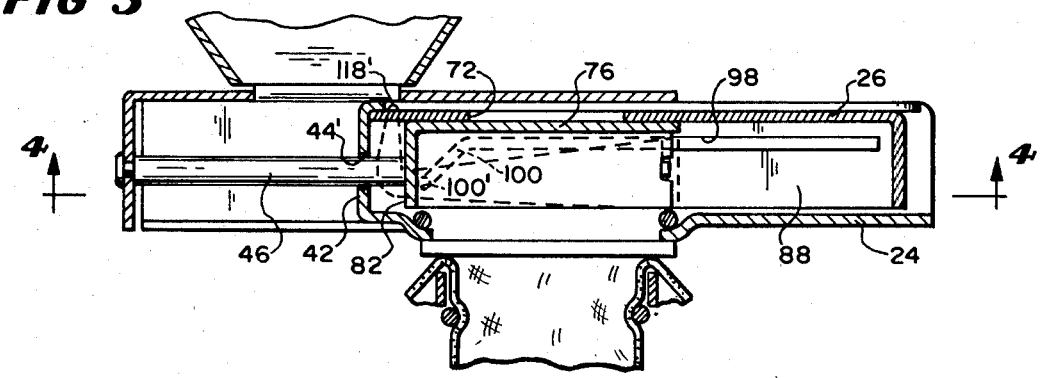
FIG. 3 is a fragmentary sectional view similar to that of FIG. 2 but illustrating the covered coin receptacle in the process of being introduced into the bracket structure.
Figure 4:
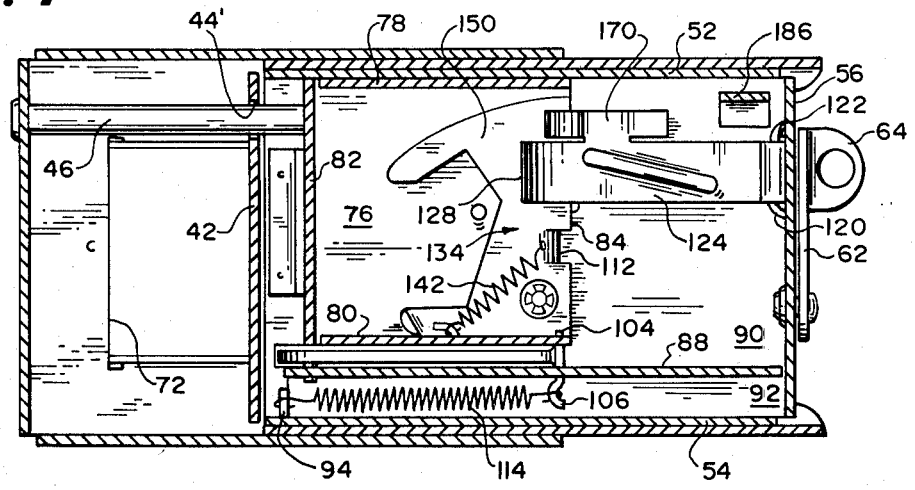
FIG. 4 is a plan sectional view taken along lines 4—4 of FIG. 3.
Figure 5:
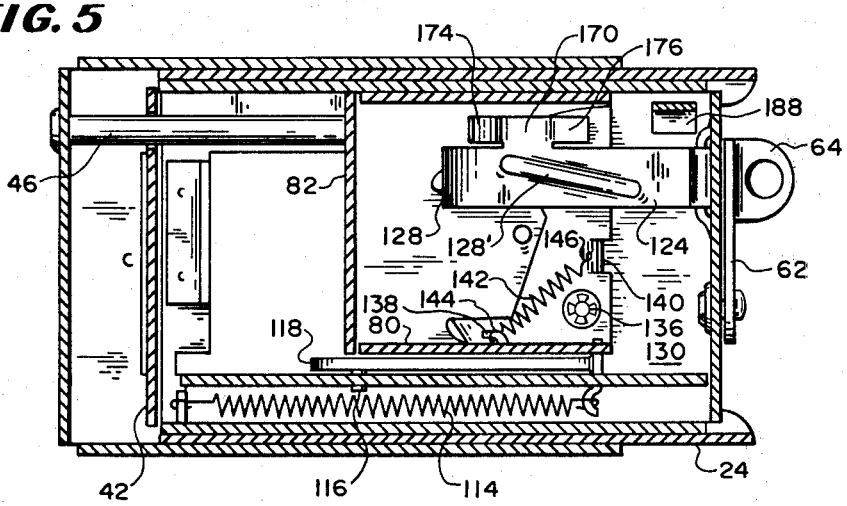
FIG. 5 is a view similar to that of FIG. 4 showing an intermediate stage of entry of the covered coin bag into the coin receptacle.
Figure 6:
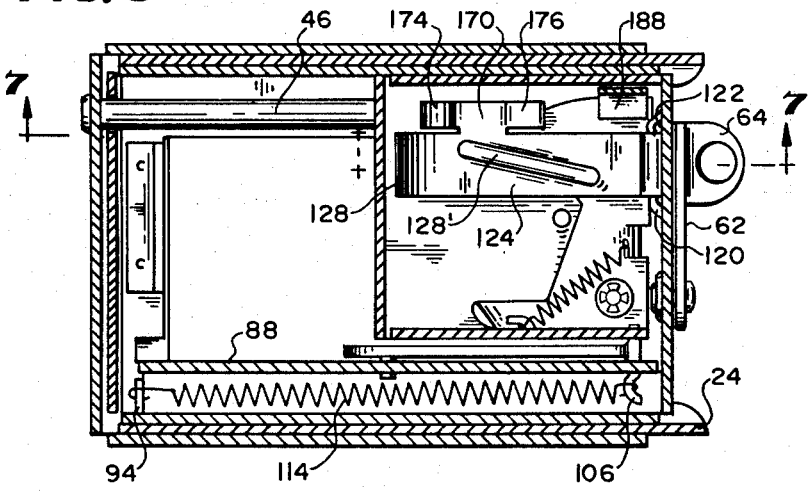
FIG. 6 is a view similar to those of FIGS. 4 and 5 but showing the cover fully introduced into the coin receptacle in the condition shown in FIG. 2.
Figure 7:
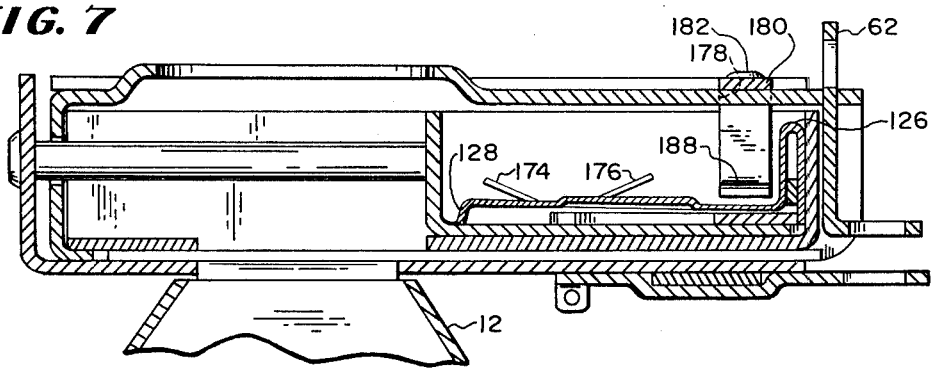
FIG. 7 is a longitudinal sectional view taken along line 7—7 of FIG. 6 viewed in the direction indicated by the arrows.

The invention herein includes, in common with the devices disclosed in pending application Ser. No. 136,889, the provision of a spring biased slide biased normally to block the window of the cover through which coins enter the receptacle when same is installed.

A cammed detent extends into the window when the slide is displaced against its normal bias during installation of the covered coin receptacle into the coin machine. The detent cooperates with the coin chute of the machine or its equivalent to block the removal of the covered receptacle from the machine unless the aforementioned window is blocked fully by the slide, return movement of the slide normally causing the detent to be retracted.

The devices disclosed in the earlier application as well as the instant device include a band spring having one end secured removably to the cover. The band spring has a bent formation at its free end biased to ride the slide during displacement of said slide. A spring biased plate or blade is mounted on the slide for pivotal movement in a plane parallel to the slide surface. The blade is carried by the slide. A notch is formed in the slide at one edge thereof and at a location on the slide aligned with the bent formation of the band spring when same is installed in the cover.

In the primed condition of the device, the blade normally is interposed between said bent formation and the notch. When the primed covered coin receptacle is introduced into its receiver, the slide is actuated to uncover the window. The bent formation first rides the surface of the blade, then drops to the slide surface. The slide and blade travel together during opening of the window. When the window is open fully, the blade is disposed rearward of the bent formation carried on the slide since the blade pivots about its mounting.

When withdrawal of the covered coin receptacle is effected, say for replacement of a coin-filled receptacle for a fresh one, the covered receptacle is drawn from its installation. As withdrawal is initiated, the slide is released to resume its normal condition, covering the window. Simultaneously, the detent is cammed to retract the same, such retraction not being completed until the slide has been translated sufficiently to cover the window.

As the slide moves to a position assumed with the window covered fully, the blade edge is intercepted by the bent formation of the band spring. Since the slide is return translated, it continues to move toward the condition assumed thereby when the window is covered fully. The blade pivots about its mounting to uncover the notch, so that the bent formation falls off the slide. The fallen bent formation engages the floor of the cover and enters the notch, bearing against said floor. The blade, now pivoted against its normal biased condition, bears against the rear of the bent formation, forcing same against the edge of the slide so long as the bent formation is disposed within the notch. Accordingly, movement of the slide in a direction necessary to again uncover the window is prevented.

It should be pointed out that the deterrence afforded by the invention is directed against surreptitions pilfering or tampering, that is tampering without leaving evidence thereof for detection. Of course, if a thief desires to gain unauthorized access to the receptacle for the purpose of a theft, he can slash the bag or apply force to the cover sufficient to gain access thereto. Obviously, immediate recognition is gained of the event because of the visible and obvious damage to the receptacle and/or cover.

When the locked covered coin receptacle is brought to the secure counting room, say at a depository, an exterior seal is broken. The cover portions heretofore were separated, the bag emptied of coins and the coins counted or otherwise tabulated. Prior to reassembly of cover portions the lock mechanism had to be primed (cooked or reset).

In order to prime the lock mechanism, the bent formation of the band spring had to be lifted manually to release the blade from the notch. Now the mechanism was reset or primed. The cover portions having been separated were reassembled to define a fresh coin receptacle ready for installation anew. The provision of the pivotable blade positively prevents tape or any other objects from effectively neutralizing the self-locking feature of the cover.

The invention herein is directly concerned with a resetting system having the capability of operation automatically upon opening of the cover. The earlier structure thus is improved because of ease of handling same to effect such resetting.

Now looking at the drawing, the receptacle adapted to be located within the coin machine for receiving the cover/bag combination of the invention includes a channel-shaped bracket 10. The covered coin bag assembly of the invention is designated by reference character 20. Many of the features and advantages of the herein improvement are common with the referenced application.

Referring now to the drawing, in FIG. 1, et seq., a locked, covered flexible coin bag assembly 20 is illustrated installed within said channel-shaped bracket 10 which carries a coin funnel 12. The funnel 12 is installed via tabs 14 within a conventional coin-receiving housing (not shown) fabricated in a coin-operated machine. Coins land onto one of the tapered walls 16 of funnel 14 and are directed to the bottom opening 18. The plural tabs 14 provide for universal installation capability.

The cover 22 of assembly 20 is formed of a pair of telescopically assembled channeled members 24 and 26 of generally rectangular configuration. A flexible, open-topped bag 28 formed of plastic or cloth material is secured onto one of said members.

The bag 28 is provided with a collar 30 having an undercut rim 32 capable of being received within the circular rimmed opening 34 formed in the member 24. The opening 34 is located for alignment with the bottom opening 18 of the funnel 14 when the assembly 20 is installed within channeled bracket 10. The rim 32 is locked in place by a split retaining ring 36 seated on rim 32 surrounding opening 34 and within circumferential groove 38 formed on rim 32 defining a swivel coupling.

The bag 28 is secured to the collar 30 so as to resist separation when installed.

Cover portion 24 includes a pair of parallel side walls 40 and an end wall 42, the same having an aperture 44' formed therein. The side and end walls 40 and 42 have right angles flanges 44 and 46. Means such as a bar 46 are provided within the bracket 10 to drive the slide during installation. Flanges 44 and 46 define a track. Upstanding tab 50 is provided formed as an upset of flange 44 and functions as a stop for retaining the assembled covered coin bag assembly within the bracket of the machine, as will be explained hereinafter.

The cover portion 26 holds the operating mechanisms of the cover 20 and includes a pair of parallel side walls 52 and 54 and end walls 56 and 58 defining a chamber 60. A pivotable latch 62 including latch hook 64 is secured to the end wall 56. The cover portion 24 carries a slot 66 located to receive the latch hook 64 when the portion 26 is received telescopically fully in portion 24. The latch 62 is rotatable pivotably into and out from the slot 66. The latch 62 also carries an aperture 68 located at the free end thereof and a plastic locking seal 70 can be passed therethrough after the latch 62 is manipulated to feed latch hook 64 through slot 66. Once seal 70 is applied and locked, breaking of the seal is required to gain access to the interior of assembly 20. This cannot be performed surreptitiously, that is, without observable detection. A second seal 70' can secure the latch 62 to the bracket 10.

The cover portion 26 has a window 72 as well as a longitudinal slot 74 opening to one corner of window 72.

Figure 8:
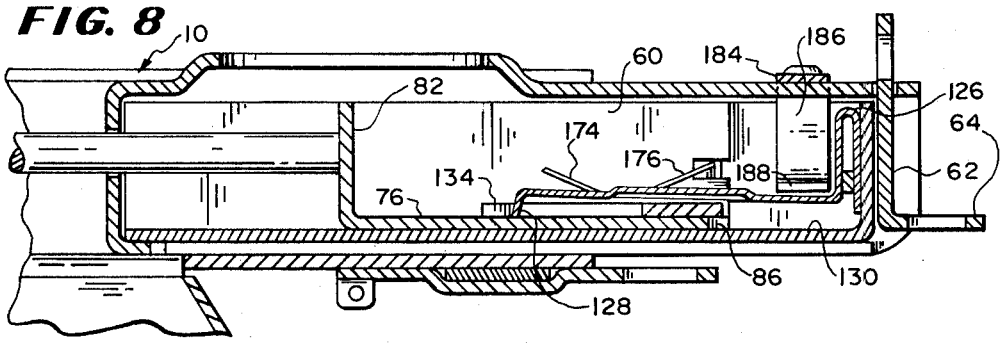
FIG. 8 is a view taken along the line 8—8 of FIG. 5 and viewed in the direction indicated by the arrows.
Figure 9:
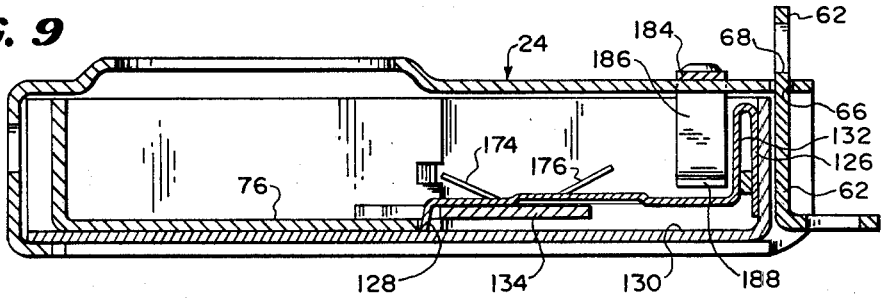
FIG. 9 is a longitudinal section taken through the locked cover in the condition thereof immediately subsequent to removal of the coin filled covered receptacle from the bracket of FIG. 1.
Figure 10:
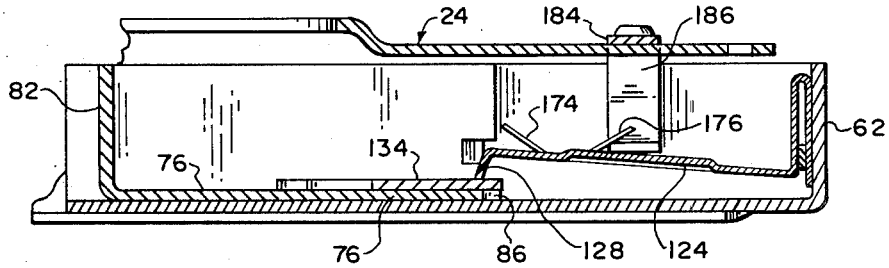
FIG. 10 is a view similar to that of FIG. 9 showing the condition of the cover assumed in the process of gaining authorized access to the loaded coin receptacle and particularly illustrating the operation of the automatic reset mechanism of the invention.

A spring-biased slide assembly is arranged within the cover portion 26 for covering and uncovering the window 72. The slide assembly includes a flat slide 76 having a pair of parallel side walls 78, 80 and a bridging end wall 82. The trailing edge 84 of slide 76 has a notch 86 formed therein (see FIGS. 8–10).

A partition 88 is secured fixedly to the cover 26 interior of chamber 60 and parallel to walls 52,54 of cover portion 26.

The partition 88 is positioned adjacent to the window 76 and defines sub-compartments 90 and 92. An apertured tab 94 is secured to cover portion 26 parallel to and adjacent the end of wall 52 in sub-compartment 92. Partition 88 carries notch 96 and an elongate longitudinal slot 98. Slot 98 is straight along most of its length but includes an arcuate angular terminal slot section 100. A flat plate 102 is sandwiched between wall 80 of the slide 76 and the partition 88. A pair of angular, oppositely directed bent lugs 104 and 106 are formed at one end of plate 102 and formation 108 is formed at the other end of plate 102. Lug 104 passes through notch 110 of wall 80 and is secured to upright lug 112 which is formed on on blade 134. The other lug 106 passes through the notch 96. Lug 106 is apertured. Expansion coil spring 114 is linked across tab 94 and lug 106.

A follower 116 is secured to the plate 102 near detent formation 118 and passes through slot 98. So long as follower 116 rides in the straight portion of the slot 98, the detent 118 is urged outward of the window 72. At arcuate section 100 of the slot 98, the follower 116 is cammed therealong to initiate the retraction of the detent 118 into the sub-chamber 92. When the follower 116 is at the terminal end 100' of the slot portion 100, the detent end 118' is fully retracted from the window 72. The detent end 118' first passes through the wall 118 of cover portion 26 via slot 94.

The wall 56 of cover portion 26 carries an outwardly protruding bridge 120 upset therefrom. Bridge 120 defines a slot 122. A generally flat band spring 124 having a clip portion 126 at one end and a downwardly bent formation 128 at its opposite end, removably is secured to the cover portion 26 passing clip portion 126 through slot 122 of bridge 120. The band spring 124 is provided with a rib 128' for strengthening purposes.

The band spring 124 is arranged parallel to the floor 130 of cover portion 26 and also extends in a direction parallel to the side walls 52,54 of said cover portion. Floor 130 is the under surface of wall 118 of said cover portion 26. The bent portion 128 is angled downwardly and the clip portion 126 which passes through the slot 122 is longer than portion 132 so that the spring 124 is spaced from floor 130. The portion 128 may be described as a latch or catch formation and is biased to bear against floor 130. The portion 128 is biased to be seated in the notch 86 formed at the trailing edge of slide 76. The band spring 124 is cantilevered toward the floor 130 with the bend 128 either seated on the slide 76, or seated within notch 86.

A flat "shutter" blade 134 is secured at 136 for slidable pivotal movement upon the slide 76 in a plane parallel to said slide. Wall 80 of slide 76 carries eye formation 138. An apertured lug 140 mounts coil spring 142 having one arm 144 seated in eye 138 and its arm 146 is secured to and wrapped about upstanding lug 140.

The blade 134 rides with the slide 76. Blade 134 also includes a large flat section 150 also slidable on the surface of slide 76 with pivotal movement of the blade 134. The section 150 is disposed to be interposed between formation 128 and the slide 76 and rests flat on the surface of said slide 76.

Normally, the bent formation 128 of band spring 124 rests upon the blade section 150. While in such condition, no impediment is offered to movement of the slide 76 to uncover the window 72. When the slide 76 is caused to move to uncover the window 72, as by post 46 passing through opening 44' in end wall 42 as the cover is forced into bracket 10, the post 48 engages the wall 82 of the slide 76 and forces the slide 76 to move against its normal bias to uncover the window 72. The slide is moved in the direction toward wall 56 of cover portion 26. The detent is cammed into slot 94 and then passes through window 76. The blade 134 and slide 76 move together. The bend 128 rests on the blade surface 150 and the conjointly moving slide and blade is translated past the said bend 128. The full opening of the window 72 is accomplished when slide and blade are moved fully to the left in the Figures.

Obviously, to accomplish such movement, the bend formation 128 must ride on the blade 134, pass over the blade 134 and drop to the slide surface.

Now, when the covered coin receptacle 20 is introduced further into bracket 12 and passed telescopically thereinto, the bend 128 drops off the blade surface 150 and rides the slide surface. The slide is positioned at its extreme left hand location against the bias of spring 114 and thus is biased toward its window-covering condition. In the return trip, taken when the loaded coverec receptacle 20 is released from the bracket 10. The bend 128 rides the slide surface and pushes the blade 134 pivoting same. The bend drops off said slide surface and engages the floor of the cover portion 26 itself. The bend 128 drops into notch 86. When window 72 is opened fully, the spring 142 forces bend 128 against the trailing edge of slide 76. In traveling, the blade 134 is forced to pivot against the bias of spring 142.

When the covered loaded coin receptacle 20 is released from bracket 10, the slide 76 moves under the bias supplied by spring 114 to return to said normal condition, that is, with the window 72 closed. The trailing edge of the blade 134 engages the rear of the bend 128. When formation 128 is seated within notch 86 of the slide, it is biased against the said trailing edge of said slide at the notch 86. The slide 76 is blocked from further slidable movement in a direction required to expose the window 72. This effectively locks the cover with the window blocked. Access to the interior of the bag is prevented.

Since non-detectable manipulation of the cover portions 24, 26 is prevented by the seal 70, undetected tampering cannot occur.

When the loaded covered bag 20 is transported to a proper secured destination and the seal 70 removed by the properly authorized individual, the cover 22 is manipulated partially to withdraw portion 26 from the portion 24. As will be apparent hereinafter, the member 24,26 constructed in accordance with this invention, cannot be fully separated.

According to the instant invention, the locking mechanism is reset automatically by lifting the bend 128 from the notch 86 during the opening of the cover 22. As the spring 124 is lifted, the blade 134 is released to return fully. In the course of its return, the blade 134 under the bias of spring 142 cams the bend 128 so that the bend rides surface 150 thereof. That is, the bend 128 is guided over the blocking trailing edge of slide 76 after being raised by the blade 134 during the return of said blade to its normal condition on the slide 76. Now the locking mechanism is primed or cocked with the bend 128 on the blade surface 150.

The cover 22 is pushed into the channeled bracket 10. Tab 50 (on cover portion 24) engages the cam edge 152 of spring biased detent 154 of the stop and retainer 156. The detent is urged against the bias of spring 158 and then returns to hold the tab 154 and prevent release of the cover from within the bracket 12. The spring 158 is secured on upstanding apertured tab 160 formed on channel-defining plate 162 welded or otherwise affixed to the channeled bracket 10 and on apertured upstanding flange 164 of detent 154. The plate 162 also is provided with extension 166 carrying aperture 168 arranged to be aligned with a second aperture formed on latch 62 and receives a seal therethrough. The window 72 is uncovered and maintained in such condition.

When the detent 154 is manipulated to release the tab 50, the cover 22 is released immediately from the bracket 12 due to the bias of spring 158, to cause its return to normal condition, i.e., window 72 covered, under the bias of spring 114. Simultaneously, the detent formation 118' is cammed out of interferent relation and within the cover 22. If one attempted to retain the window 72 open or even partially open, removal of the covered bag 20 from bracket 10 would not be possible. Since the detent formation 116' fully is retracted into the cover 22, access thereinto is not possible without resulting observable damage or leaving of traces of such tampering.

The bend formation 128 falls into notch 86 and prevents movement of the slide 76 to reopen the window.

As shown in FIG. 1, the locked coin receptacle 20 can be serviced by a serviceman. The serviceman has been supplied with locked empty bags by his employer. The installed loaded receptacle 20 is withdrawn from the bracket 10, automatically resulting in release of the slide 76 to cover the window 72. A fresh locked covered bag with the bend 128 reset, slidably is installed in the bracket 10.

The loaded receptacle 10 which has been removed then is placed in a secure receptacle, such as a tumble or rotary safe. Any attempt to gain access to the content of the container by the serviceman or other unauthorized personnel will result in visible evidence of such attempt—surreptitious tampering being impossible without detection.

The band spring 124 has an integral portion 170 extending outward horizontally coplanar from edge 172 of said spring 124 at a location closely adjacent the bend 128. A pair of upwardly directed tabs 174 and 176 are formed from the portion 170 on opposite sides thereof.

Slot 178 is formed in cover portion 24. A right angle bracket 180 is fastened to the exterior of cover portion 24 by rivet 182 through leg 184 with leg 186 of bracket 180 disposed through slot 178 to emerge interior of said channeled portion 24. The interior disposed end of bracket 180 has right angle bend 188. The end portion 188 is directed toward the band spring 124 at a location where it is disposed in the path taken by the tab portion 176 during the movement of the cover portion 26 when the same is manipulated to gain access to the loaded coin bag. The band spring 124 then is lifted to lift the bend 128 from the notch 86 a distance sufficient to release blade 134. The bend 128 then rides said blade and is reset. Accordingly, when the member 26 has been withdrawn from member 24 to the degree sufficient to uncover the coin opening enabling removal of the coins, the locking mechanism automatically is placed in its reset or primed condition. The leg 186 coacts with wall 82 to prevent separation of the members 24 and 26.

The upraised tab 174 permits return of the cover portions 24 and 26 to their fully telescopically engaged condition without interference by the leg 186. Obviously, when the cover portions are reengaged, a new seal is applied. If desired, a plate (not shown) can cover the compartment or chamber 92 containing spring 114 also to deter entry via an instrument or taping or the like locking counter-effort. The cover plate last mentioned can be cantilevered to have its free end in position to block return to the fully telescopically engaged condition of members 24,26. This makes it easier for the operator to remove the coins from the bag as the cover is positively maintained particularly separated. The said free end can be easily urged out of the way for intentional return to fully telescoped condition. A cover (also not shown) can be formed over the slide for further protection against unauthorized intrusion.

With the configuration of the angle bracket 180 and particularly that of bend 188, the angle at which tabs 174,176 are oriented should be sufficient to be engaged by the bend 188 so that the spring 124 and particularly the portion 128 thereof is lifted to clear the edge of slide 76. Preferably the angles found effective are in the range of about 20° to 40°, with preference being about 30°. The angle at which the bend 188 meets the tab 176 must be sufficient to effect the camming action, causing the necessary lifting to take place.

I claim:

1. In a self-locking cover assembly for a coin receptacle mountable within a channeled bracket which is secured in communication with the coin delivery chute of a coin operated machine, the self-locking cover assembly including first and second channeled members telescopically engaged, the first channeled member having a window alignable with the delivery chute and a latch assembly, said first channeled member having slide means seated for slidable movement within the cover for selectively covering and uncovering the window, first spring means operable within the cover to bias the slide means in window covering condition and second spring means operably seated within the cover assembly selectively to block movement of the slide means whereby to prevent uncovering of the window when the covered receptacle is withdrawn from the channeled bracket, the invention comprising reset means automatically operable to release said second spring means subsequent to operation thereof for the purpose of preventing uncovering of the window, said reset means comprising cam means on one of the second spring means and first channeled member for displacing said second spring from a blocking condition blocking movement of said slide means and follower means on the other one of said second spring means and first channeled member interceptable by said cam means during withdrawal of said channeled members from their full telescopic engagement subsequent to withdrawal of the cover from the channeled bracket in locked condition.

2. The structure as claimed in claim 1 and means preventing full separation of said channeled cover members.

3. The structure as claimed in claim 1 wherein said second spring means comprise a band spring secured at one end thereof to the first channeled member and having a latch formation at the opposite end thereof, said cam means comprising an angular formation interposed in the path taken by said spring during partial separation of said channeled members, and said follower means comprise a tab means formed integral with said band spring and disposed to be engaged by said angular formation during said partial separation.

4. The structure as claimed in claim 3 wherein said tab means comprise an upwardly directed tab integral with said band spring.

5. The structure as claimed in claim 1 wherein said second spring means comprise a generally flat band spring having a hook formation at one end thereof securable to said first channel member and a free end at the opposite end thereof, said free end terminating in a downwardly depending latch biased toward the floor of said first channel member and disposed in blocking condition relative to said slide means, whereby to prevent uncovering of the window.

6. The structure as claimed in claim 5 and blade means mounted on said slide means for parallel planar movement relative thereto whereby to carry said depending latch continuously between a condition resting on the slide means and a condition whereat the depending latch engages the trailing edge of said slide means to block movement of said slide means.

7. The structure as claimed in claim 5 wherein said blade means is spring biased for pivotal movement in the same direction as the movement of the slide during the uncovering of the window.

8. The structure as claimed in claim 5 and said blade means bears against said latch forcing same against said trailing edge preventing uncovering of the window.

9. The structure as claimed in claim 1 where said follower means comprise a unitary portion extending generally coplanar with said second spring means in a direction outward of the longitudinal edge thereof and at least one upwardly directed raised portion upset from said unitary portion and capable of being engaged by said cam means.

10. The structure as claimed in claim 9 wherein said unitary portion includes tabs upset therefrom and extending in opposite directions, said tabs each having a free end of generally arcuate configuration presenting a surface to said cam means for lifting by said cam means during transit thereof therepast.

11. The structure as claimed in claim 10 in which said cam means comprise a depending arm secured to said first channel member and extending interior thereof, said depending arm including a terminal angled cam portion arranged to be intercepted by at least one of said tabs to lift said spring means from blocking condition, releasing the blade and slide conjointly.

12. The structure as claimed in claim 10 and said cam means arranged to intercept the upset portions during movement of said channel members divergently.

13. The structure as claimed in claim 1 and raised tab means enabling the converging movement of said channel members telescopically fully to engage one within the other.

14. A cover assembly adapted to be locked onto a coin receptacle capable of being inserted into a preformed recess of a coin-controlled machine of the type that has an interior coin chute having a delivery end opening to the recess and including a top wall having a window alignable with said delivery end when the cover is engaged on the coin receptacle and together therewith is installed within the recess, slide means seated for slidable movement within the cover to cover and uncover the window, first spring means secured to the cover and to the slide means for biasing the slide means to a condition whereat the window is covered and second spring means arranged within said cover and operable upon said slide means to permit movement thereat upon one condition and prevent said movement upon a second condition, detent means within said cover and operable with movement of said slide means, said detent means being disposed normally away from said window, said slide means operable to drive said detent means positively into said window when said slide means is manipulated against the bias of said first spring means partially or fully to uncover said window to prevent withdrawal of the covered coin receptacle except when the window is fully covered, said second spring means comprising a generally flat spring having a first formation at one end thereof securable to said cover and a free opposite end arranged biased thereagainst, a catch formation on said free end, said catch formation being ridable upon said slide means during movement thereof, spring biased shutter blade means interposed between said catch formation and said slide means, said shutter blade means being mounted for movement with said slide means during uncovering of said window and for pivotal movement against its bias during return movement of said slide means, said blade means capable of being intercepted by said catch formation during return movement of said slide means to effect said pivotal movement whereby to bias said catch formation against said slide means, to prevent further movement thereat, and means for automatically resetting said lock mechanism for reuse subsequent to withdrawal of the covered receptacle from said recess, said last mentioned means comprising cam and follower means arranged to lift the catch formation above the edge of said slide means simultaneously when access is gained to the coin receptacle subsequent to the withdrawal thereof from said recess.

15. The structure as claimed in claim 14 in which said slide means includes notch means formed therein, said catch formation being aligned with said notch means whereby to engage therein upon return of said slide means covering said window.

16. The structure as claimed in claim 15 in which said cam and follower means act to lift said catch formation from said notch means to effect resetting said cover assembly for reinstallation, said shutter blade means being released to return to a condition interposed between said catch formation and said slide means.

17. The structure as claimed in claim 14 wherein said cam and follower means includes tab means formed on said second spring and a cam surface movable with movement of said channeled members at least partially one relative to the other to uncover said window.

18. The cover assembly as claimed in claim 14 and spring biased retainer means on said bracket and cover releasably to lock the covered receptacle within said bracket.

19. The cover assembly as claimed in claim 1 and wherein said coin receptacle comprises a flexible coin receiving bag coupled to said second channeled member in communicating relationship with said window when the window is uncovered.

20. The cover assembly as claimed in claim 14 and wherein said coin receptacle comprises a flexible coin receiving bag coupled to said second channeled member in communicating relationship with said window when the window is uncovered.

* * * * *